US005092828A

United States Patent [19]

Marchetti

[11] Patent Number: 5,092,828

[45] Date of Patent: Mar. 3, 1992

[54] DEVICE FOR FEEDING FLATTENED AND PILED CARDBOARD BOXES TO A VERTICAL MAGAZINE LOCATED ON THE TOP OF A MACHINE FOR FORMING CARDBOARD BOXES

[76] Inventor: Augusto Marchetti, Piazza Sicilia, 7, 20146 Milano, Italy

[21] Appl. No.: 593,813

[22] Filed: Oct. 5, 1990

[30] Foreign Application Priority Data

Oct. 6, 1989 [IT] Italy ..... 21938 A/89

[51] Int. Cl.[5] ..... B65H 3/04; B31B 1/80

[52] U.S. Cl. ..... 493/313; 493/309; 271/3.1

[58] Field of Search ..... 493/309, 313, 315, 316, 493/317; 271/3.1, 198

[56] References Cited

U.S. PATENT DOCUMENTS

| | | | |
|---|---|---|---|
| 3,580,143 | 5/1971 | McIntyre | 493/313 |
| 3,591,018 | 7/1971 | Nalbach | 271/3.1 |
| 3,635,463 | 1/1972 | Stobb | 271/3.1 |
| 3,680,854 | 8/1972 | Daily et al. | 271/3.1 |
| 3,814,000 | 6/1974 | Heisler | 493/316 |
| 3,827,576 | 8/1974 | Ward, Jr. et al. | 271/3.1 |
| 4,072,090 | 2/1978 | Heisler | 493/313 |
| 4,364,549 | 12/1982 | Komossa et al. | 271/3.1 |
| 4,403,900 | 9/1983 | Thomas | 271/3.1 |
| 4,432,539 | 2/1984 | Fischer . | |
| 4,452,440 | 6/1984 | Fagan et al. | 271/3.1 |
| 4,478,400 | 10/1984 | Commers | 271/3.1 |
| 4,934,682 | 6/1990 | Rece et al. | 271/3.1 |

*Primary Examiner*—Bruce M. Kisliuk
*Assistant Examiner*—John A. Marlott
*Attorney, Agent, or Firm*—Cushman, Darby & Cushman

[57] ABSTRACT

A transfer assembly to progressively transfer to a main vertical magazine located at the top of a machine for forming cardboard boxes, the cardboard box at the top of the pile of cardboard boxes located in an auxiliary magazine to one side of the forming machine. There is associated with the transfer assembly, opposite the top of auxiliary magazine, a solenoid valve through which the upward movement of the cardboard boxes in auxiliary magazine is stopped in the time interval between the start of the withdrawal of the cardboard box from the auxiliary magazine and its positioning on rollers. At the top of the main magazine there is an upper photocell suitable for stopping the movement of the transfer assembly when the main magazine is full and a lower photocell suitable for putting the same assembly back in motion when the number of cardboard boxes contained in main magazine is lower than a certain threshold.

5 Claims, 4 Drawing Sheets

DEVICE FOR FEEDING FLATTENED AND PILED CARDBOARD BOXES TO A VERTICAL MAGAZINE LOCATED ON THE TOP OF A MACHINE FOR FORMING CARDBOARD BOXES

BACKGROUND OF THE INVENTION

The present invention relates to a device for feeding flattened and piled cardboard boxes to a vertical magazine located on the top of a machine for forming cardboard boxes.

The machines for forming cardboard boxes are well-known to be those machines which, starting with carboard boxes folded in a flat form, open them up to a box form and close their bottom part by doubling over appropriate foldable flaps protruding from the box's walls. Known machines of this type, such as, say, that described in the U.S. Pat. No. 4,857,038, of Tacchini, issued Aug. 15, 1989, withdraw the cardboard boxes, flattened and piled one on top of the other, from a verticalaxis magazine located on the top of the machine.

The problems common to all machines for forming cardboard boxes with a vertical magazine on top are represented by the limited capacity for storing the cardboard boxes, deriving from the need to keep within acceptable limits the weight of the magazine and the machine's overall height. At the same time it would be preferable to have a large capacity magazine so as not to have to arrange to have it replenished so frequently.

SUMMARY OF THE INVENTION

The object of the present invention is that of providing such forming machines with means capable of overcoming the above drawback.

According to the invention such object is attained with a device for feeding flattened and piled cardboard boxes to a main vertical magazine located on the top of a machine for forming cardboard boxes, characterized in that it comprises an auxiliary magazine located to one side of the forming machine to receive a pile of folded cardboard boxes and transfer means for the progressive transfer of the cardboard box successively at the top of the pile of cardboard boxes from the auxiliary magazine to the main magazine of the forming machine.

In this way, while still limiting the height of the main vertical magazine and thus of the forming machine as a whole, an auxiliary magazine is made available which can be of substantial capacity and is immediately accessible for refilling the main magazine.

BRIEF DESCRIPTION OF THE DRAWINGS

The features of the present invention shall be made more evident by the following detailed description of an embodiment, illustrated as a non-limiting example in the attached drawings, wherein.

DETAILED DESCRIPTION

Figure 1:
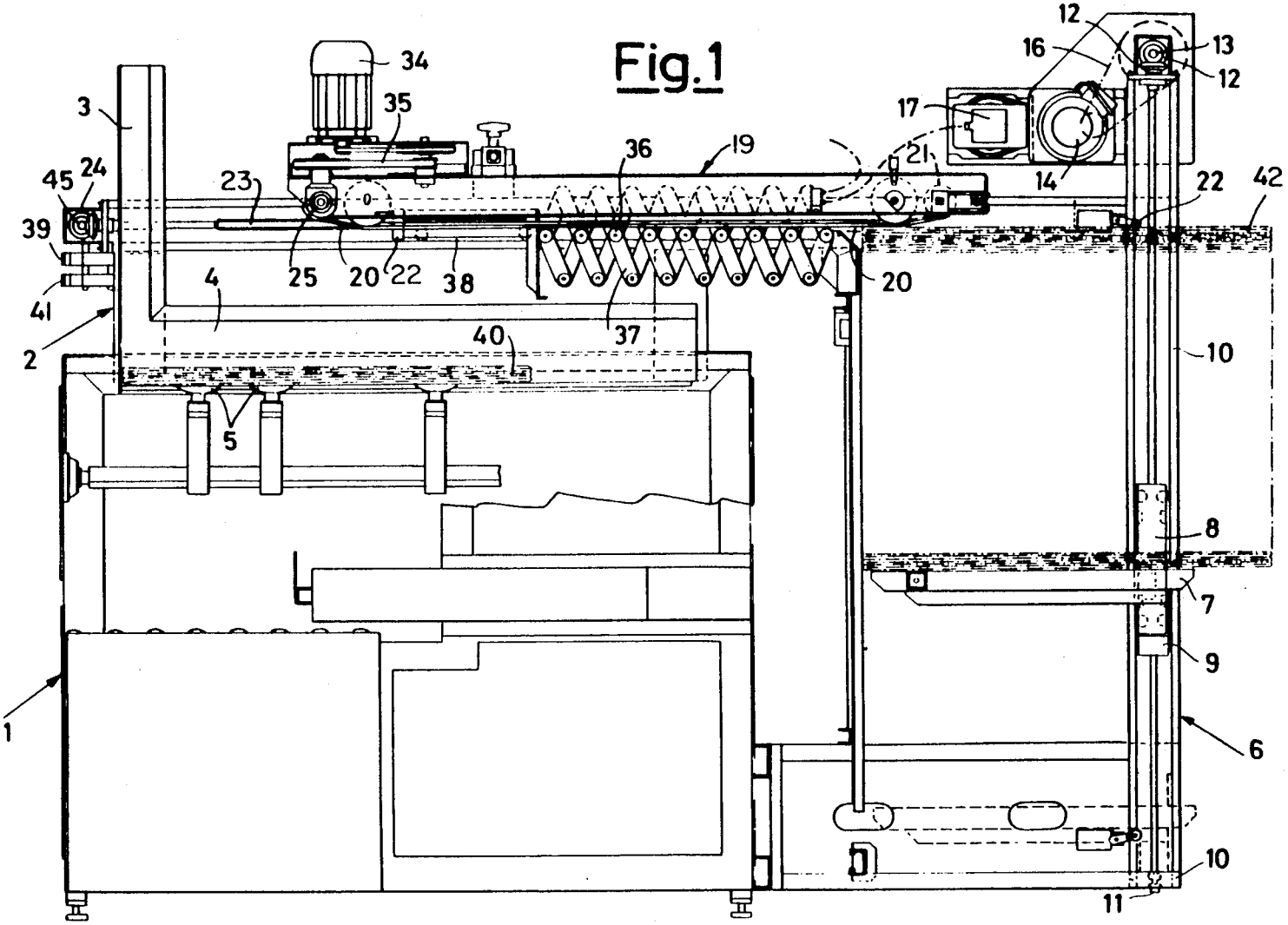
FIG. 1 shows a side view of a forming machine provided with a device according to the invention, seen in a longitudinal cross-section.

With reference to FIG. 1, the forming machine indicated as a whole with 1 comprises a main vertical magazine 2 located on its top, defined by two uprights 3 and by two sides 4, from which the individual carboard box is withdrawn for the subsequent forming treatment by means of suction cups 5.

Figure 2:
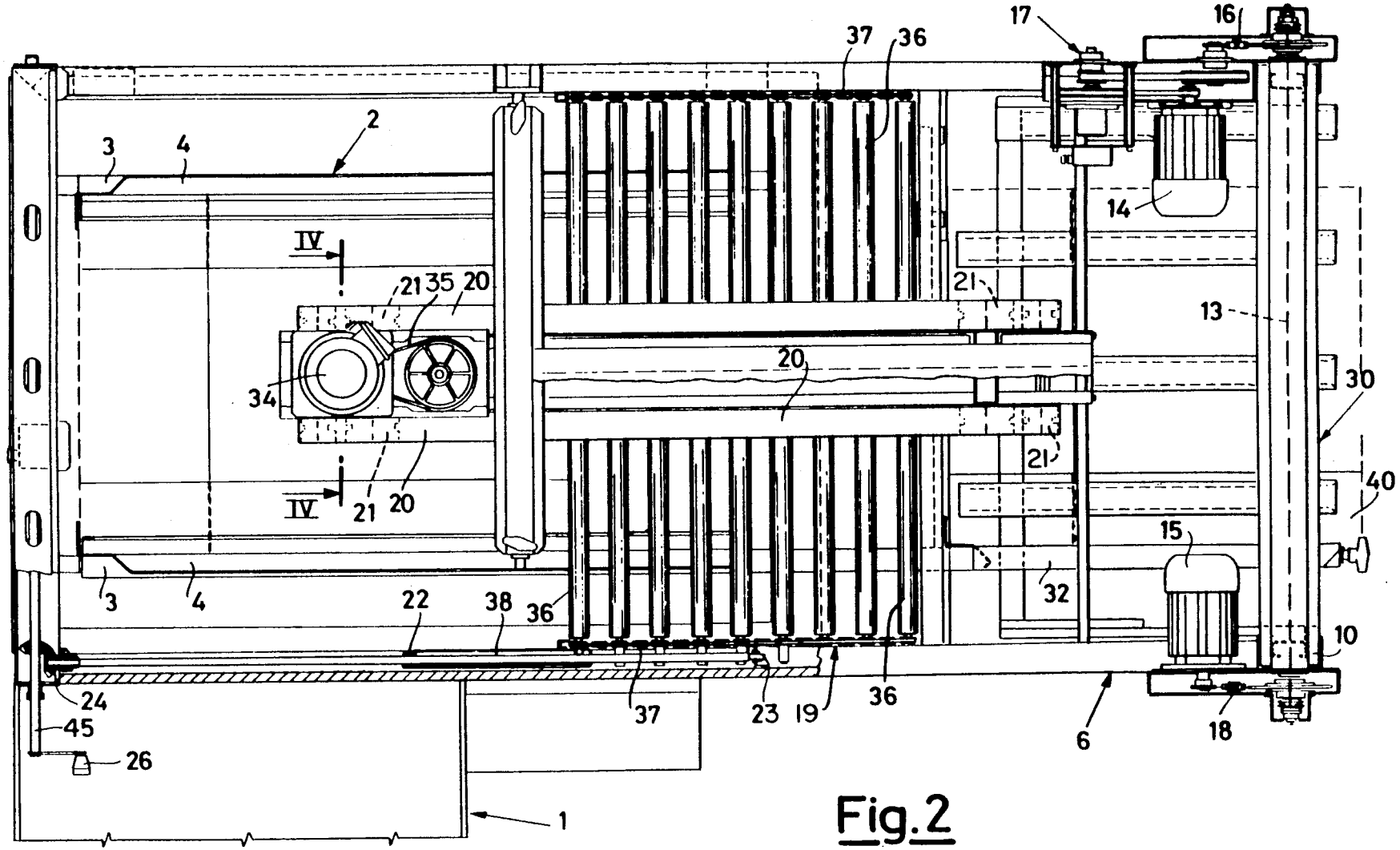
FIG. 2 shows the machine-device assembly seen from the top.

On one side of the forming machine 1 there is located an auxiliary magazine 6 (FIGS. 2 and 3) formed by a fixed frame 30, by a vertically-movable plate 7, and by a guide 32 fastened to one of the sides 4 of the main magazine 2 for the lateral horizontal positioning of the piled carboard boxes. The plate 7 is supported laterally by sleeves 8 fastened to respective nutscrews 9 capable of sliding without rotation along uprights 10 of frame 30 of auxiliary magazine 6 and in engagement with respective upright screws 11 which are connected at the top by means of a bevel gear pair 12 to a common horizontal shaft 13 (FIGS. 1 and 3).

The shaft 13 is suitable for receiving motion alternately from a slow motor 14 or from a fast motor 15. In particular shaft 13 is constantly in engagement with fast motor 15 through a chain transmission 18 (FIGS. 2 and 3) and is also normally in engagement with slow motor 14 through a chain transmission 16 and may be disconnected from it by means of a pneumatically-controlled clutch 17.

Figure 4:
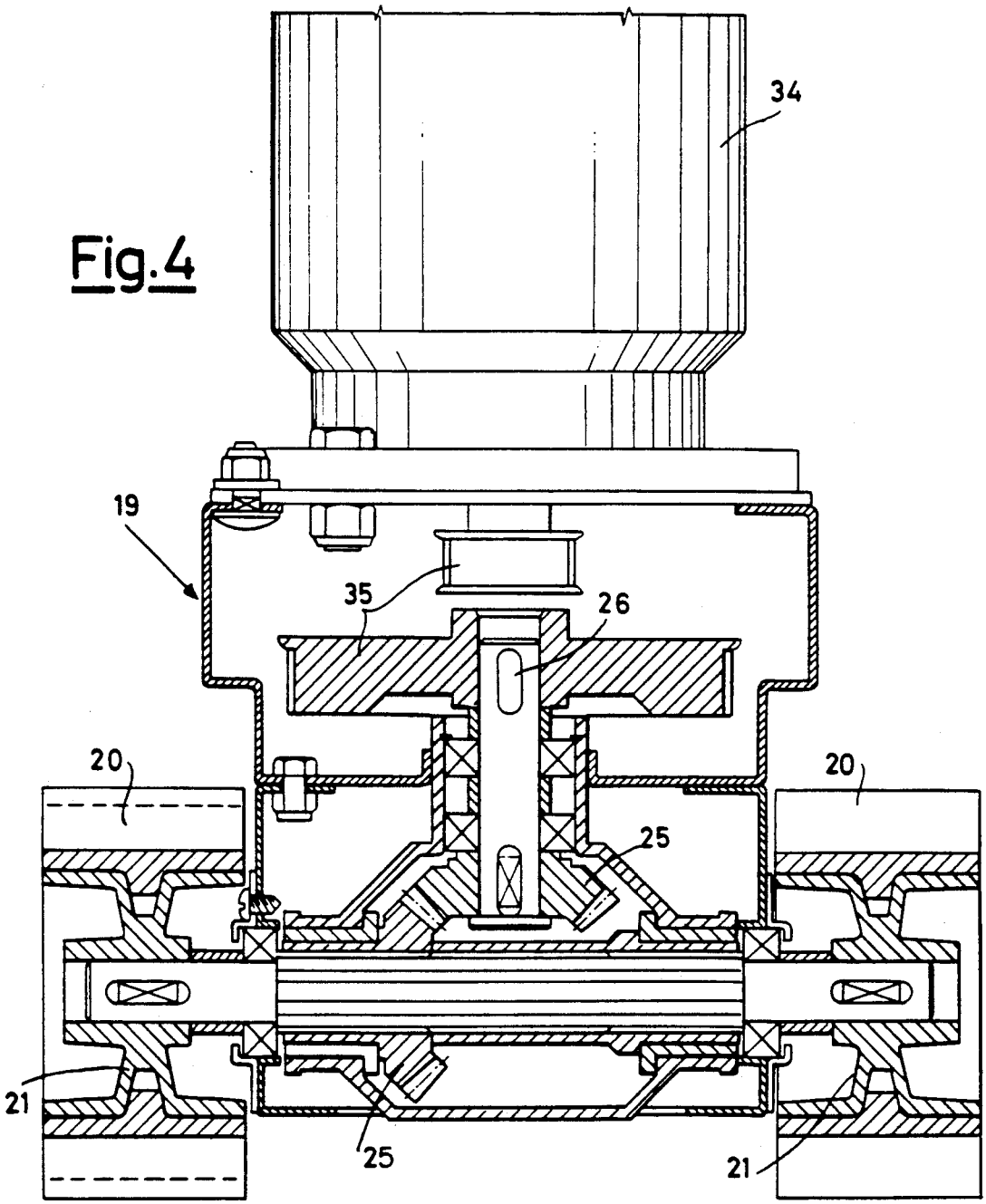
FIG. 4 shows an enlarged detail of the transfer means of the carboard boxes seen in a cross-sectional view taken along the line IV—IV of FIG. 2.

Between the main magazine 2 of forming machine 1 and the auxiliary magazine 6 there is a transfer assembly for the individual carboard boxes indicated as a whole with reference number 19 and comprising a pair of belts 20 for withdrawing the cardboard box from the top of auxiliary magazine 6, supported and operated by rollers 21. As shown in FIG. 4, the rotation of rollers 21 is attained by means of pairs of bevel gears 25 connected to a shaft 26 which is, in turn, caused to rotate by a motor 34 by means of a belt transmission 35.

Figure 3:
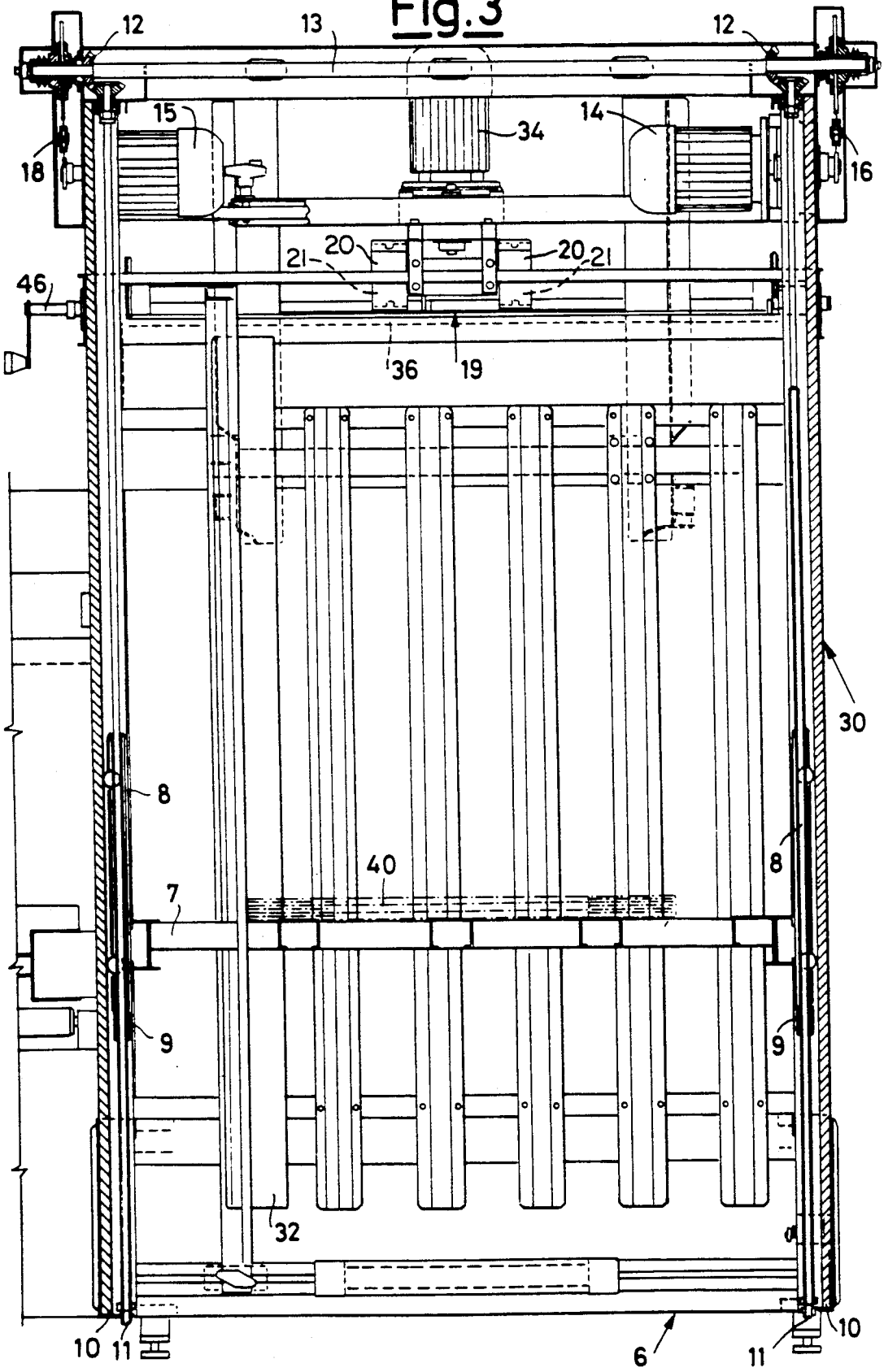
FIG. 3 shows the machine-device assembly seen from the rear.

During its transfer from one magazine to the other, executed by belts 20, the cardboard box rests on a succession of idle rollers 36 held laterally by pantograph-type frames 37 whose rear end is fixed and whose front end is fastened to sliding sleeves 38 integral with nutscrews 22 engaged with horizontal screws 23 connected by means of pairs of bevel gears 24 to a driving shaft 45 with an operating crank 46 (FIGS. 1 and 3). In this way it is possible to execute the adjustment of the front end of the roller supporting frames 36, and thus of the position at which the carboard box starts to fall off rollers 36 into magazine 2, in relation to the dimensions of the cardboard boxes.

With the transfer assembly 19, at the top of auxiliary magazine 6, there is associated a solenoid valve 42 through which the upward movement of the cardboard boxes in auxiliary magazine 6 is stopped in the time interval between the start of the withdrawal of the cardboard box from the auxiliary magazine 6 and its positioning on rollers 36.

On the top of the vertical magazine 2 there are an upper photocell 39 suitable for stopping the movement of belts 20 when the magazine is full and a lower photocell 41 suitable for putting belts 20 back in motion when the number of cardboard boxes contained in the magazine is lower than a certain threshold.

With reference to the figures mentioned above the operation of the device is as follows.

Initially, with slow motor 14 disabled thanks to clutch 17, fast motor 15 is operated to take the plate 7, holding no cardboard boxes, to the lower extremity of frame 30 in auxiliary magazine 6. Fast motor 15 is then deactivated. There is placed on plate 7 a horizontal pile of cardboard boxes 40, which is positioned horizontally through guide 32. Slow motor 14 is then operated and clutch 17 is activated to allow slow motor 14, which slowly drives the fast one, to control the upward movement of plate 7 with the pile of cardboard boxes. When the cardboard box at the top of the pile reaches the upper extremity of auxiliary magazine 6 the driving engagement is accomplished between the cardboard box itself and belts 20, as well as contact between the cardboard box and solenoid valve 42, which stops motor 14 and thus the upward movement of the cardboard boxes. The cardboard box is then transferred by belts 20 to supporting rollers 36, thus abandoning solenoid valve 42, which restarts motor 14, so that plate 7 with the pile of cardboard boxes starts to rise again. When the cardboard box moved forward by belts 20 and supported by rollers 36 reaches the front end of supporting roller frame 37, the cardboard box itself falls into main magazine 2 adding itself to the previously formed pile. From magazine 2 the cardboard boxes are then withdrawn, in a known way, by suctions cups 5 for the subsequent forming treatment.

I claim:

1. A device for feeding flattened and piled cardboard boxes to a main vertical magazine located on the top of a machine for forming cardboard boxes, comprising:

an auxiliary magazine located to one side of the forming machine to receive a pile of folded cardboard boxes; transfer means for the progressive transfer of the cardboard box successively at the top of said pile of cardboard boxes from said auxiliary magazine to said main magazine of the forming machine;

said auxiliary magazine comprising a fixed frame and a support plate for piled cardboard boxes which is movable vertically with respect to said frame;

motor means for controlling the movement of said plate;

means for transmitting motion from said motor means to said plate;

said motor means comprising a fast motor for downward vertical movement of said plate and a slow motor for upward vertical movement of said plate, which are selectable alternately one to the other;

clutch means which are controllable to disengage said slow motor from said means for transmitting motion in case said fast motor is activated.

2. The device of claim 1, further comprising:

at the top of said vertical magazine there is a photocell means arranged for stopping the movement of the transfer assembly when the main magazine is full; and at the top of said vertical magazine there is a photocell means arranged for putting the transfer assembly back in motion when the number of cardboard boxes contained in main magazine is lower than a certain threshold.

3. A device for feeding flattened and piled cardboard boxes to a main vertical magazine located on the top of a machine for forming cardboard boxes, comprising:

an auxiliary magazine located to one side of the forming machine to receive a pile of folded cardboard boxes; transfer means for the progressive transfer of the cardboard box successively at the top of said pile of cardboard boxes from said auxiliary magazine to said main magazine of the forming machine;

said transfer means comprising a pair of motorized belts which are usable for driving with the upper face of the respective cardboard box at the top of the pile of cardboard boxes in said auxiliary magazine and an underlying plane of idle rollers for supporting the withdrawn cardboard box up to the main magazine;

said rollers being held laterally by pantograph-type frames whose rear end is fixed and whose front end is movable horizontally to define a variable length of said roller plane in relation to the dimensions of the cardboard boxes.

4. The device of claim 3, wherein:

there is associated with the transfer assembly, opposite the top of said auxiliary magazine, a solenoid valve arranged for stopping the upward movement of the cardboard boxes in said auxiliary magazine in the time interval between the start of the withdrawal of the cardboard box from said auxiliary magazine and its positioning on said rollers.

5. The device of claim 3, further comprising:

at the top of said vertical magazine there is a photocell means arranged for stopping the movement of the transfer assembly when the main magazine is full; and at the top of said vertical magazine there is a photocell means arranged for putting the transfer assembly back in motion when the number of cardboard boxes contained in main magazine is lower than a certain threshold.

* * * * *